US010568370B2

(12) United States Patent
Olvera

(10) Patent No.: US 10,568,370 B2
(45) Date of Patent: Feb. 25, 2020

(54) BIB OVERALLS

(71) Applicant: Arthur R. Olvera, Chicago, IL (US)

(72) Inventor: Arthur R. Olvera, Chicago, IL (US)

( * ) Notice: Subject to any disclaimer, the term of this patent is extended or adjusted under 35 U.S.C. 154(b) by 120 days.

(21) Appl. No.: 15/090,758

(22) Filed: Apr. 5, 2016

(65) Prior Publication Data

US 2017/0013891 A1 Jan. 19, 2017

Related U.S. Application Data

(60) Provisional application No. 62/156,219, filed on Jul. 13, 2015.

(51) Int. Cl.

| | |
|---|---|
| ***A41D 13/06*** | (2006.01) |
| ***A41D 13/02*** | (2006.01) |
| ***A41F 15/00*** | (2006.01) |

(52) U.S. Cl.

CPC ..... *A41D 13/06* (2013.01); *A41D 13/02* (2013.01); *A41D 2300/322* (2013.01); *A41D 2400/44* (2013.01); *A41F 15/002* (2013.01)

(58) Field of Classification Search

CPC ..... A41D 13/02
USPC ..... 2/79, 82, 231, 46, 69.5, 80, 23, 51, 81
See application file for complete search history.

(56) References Cited

U.S. PATENT DOCUMENTS

| | | | | |
|---|---|---|---|---|
| 2,501,111 | A * | 3/1950 | Walker | A41D 13/02 2/231 |
| 4,549,315 | A * | 10/1985 | English | A62B 17/003 2/227 |
| 5,359,731 | A * | 11/1994 | Cavalier | A41D 1/06 2/227 |
| 6,567,989 | B1 * | 5/2003 | Martinez | A41D 13/00 2/211 |
| D505,772 | S * | 6/2005 | Helbing | D2/743 |
| 8,127,370 | B2 * | 3/2012 | Nunn | A41D 1/08 2/227 |
| 2012/0174285 | A1 * | 7/2012 | Williams | A41B 13/00 2/80 |
| 2016/0183615 | A1 * | 6/2016 | Abouchahla | A41F 3/02 2/323 |

* cited by examiner

*Primary Examiner* — Katherine M Moran
(74) *Attorney, Agent, or Firm* — Quarles & Brady LLP

(57) ABSTRACT

A garment includes a trouser portion including first and second legs, a bib portion having a bib front section connected to a front portion of the trouser portion and a bib rear section connected to a rear portion of the trouser portion, wherein first and second gaps having no material are formed adjacent two opposing sides of the trouser portion between the bib front and rear sections, and a first fastener extending between an end of the first leg opposite the bib portion and an edge of the trouser portion forming one of the first and second gaps.

13 Claims, 3 Drawing Sheets

BIB OVERALLS

RELATED APPLICATIONS

The present application claims the benefit of U.S. Provisional Application Ser. No. 62/156,219, entitled "Full Leg Zipper", the disclosure of which is hereby incorporated by reference in its entirety.

FIELD OF THE DISCLOSURE

The present disclosure relates generally to bib overalls and, more particularly to bib overalls that are easily put on.

BACKGROUND

Bib overalls or coveralls are oftentimes worn by tradesmen to protect their clothing and/or body and/or keep a user insulated. For example, in the construction industry, workers wear, for example, bib overalls underneath a jacket or other outerwear. The bib overalls are pulled on over a user's feet, fastened over the user's shoulders, and a partial zipper on a front section of the overalls is zipped. The overalls prevent the user's pants from collecting dirt and/or debris. Similar overalls are used for many other purposes, such as, for outdoor activities (e.g., hunting, etc.), outdoor sports (e.g., skiing, snowboarding, snowmobiling, etc.), and in many other trades (e.g., bricklaying, electrical, etc.).

While bib overalls are useful, there are many disadvantages to such a garment. One disadvantage is that a user must generally balance on one leg or sit down in order to put on the bib overalls. Another disadvantage is that a user must either remove their footwear or introduce their footwear into the garment when putting the bib overalls on. Footwear may oftentimes be dirty, wet, or otherwise soiled, thereby unnecessarily introducing such dirt and debris into the garment, which in turn, may soil the user's clothing after the bib overalls are put on. Still further, a user generally has to drag the overalls on the ground while putting them on.

SUMMARY

In illustrative embodiments, a garment comprises a trouser portion including a trunk portion and first and second legs connected to and extending away from the trunk portion, the trunk portion including a trunk front section, a trunk rear section, and first and second trunk side section positioned between the trunk front and rear sections. The garment may further include a bib portion having a bib front section connected to the trunk front section and a bib rear section connected to the trunk rear section, wherein first and second gaps having no material are formed between upper edges of the first and second trunk side portions and the bib front and rear sections, respectively, and a first fastener extending between an end of the first leg opposite the trunk portion and the upper edge of the first trunk side portion.

In further illustrative embodiments, a garment comprises a trouser portion including first and second legs and a bib portion having a bib front section connected to a front portion of the trouser portion and a bib rear section connected to a rear portion of the trouser portion, wherein first and second gaps having no material are formed on two opposing sides of the trouser portion between the bib front and rear sections. The garment may further include a first fastener extending between an end of the first leg opposite the bib portion and an edge of the trouser portion forming one of the first and second gaps.

In illustrative embodiments, a method is disclosed for using a garment comprising including first and second legs, a bib portion having a bib front section connected to a front portion of the trouser portion and a bib rear section connected to a rear portion of the trouser portion, wherein first and second gaps having no material are formed on two opposing sides of the trouser portion between the bib front and rear sections, a first fastener extending between an end of the first leg opposite the bib portion and an edge of the trouser portion forming the first gap, and a second fastener extending between an end of the second leg opposite the bib portion and an edge of the trouser portion forming the second gap. The method comprises the steps of positioning the garment with the first and second fasteners unfastened and with an inner surface of the trouser portion between the legs of a user with, fastening the first fastener, and fastening the second fastener.

BRIEF DESCRIPTION OF THE DRAWINGS

The embodiments will be more readily understood in view of the following description when accompanied by the below figures and wherein like reference numerals represent like elements.

DETAILED DESCRIPTION

Figure 1:
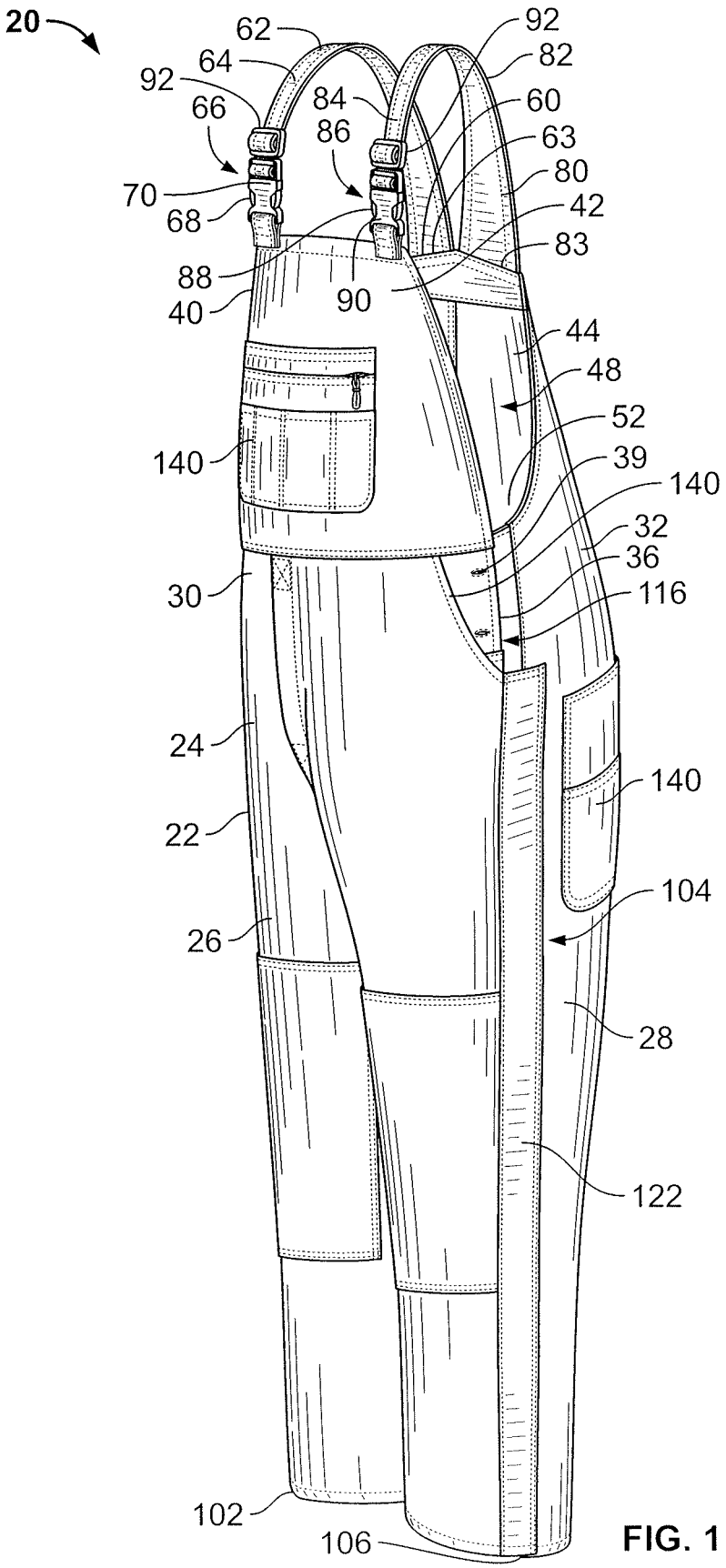
FIG. 1 is a top perspective view of an embodiment of bib overalls in an expanded condition, as if worn by an individual.
Figure 2:
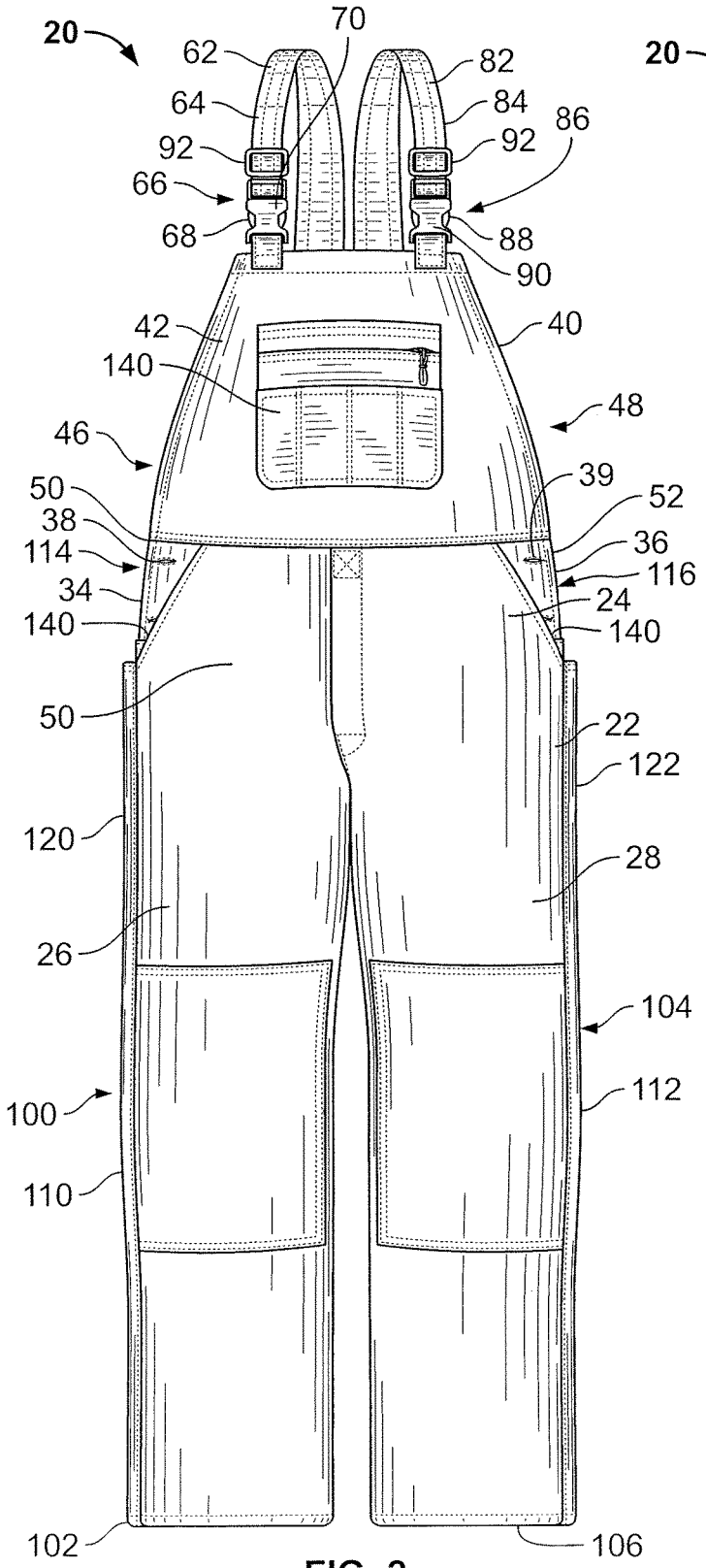
FIG. 2 is a front elevational view of the bib overalls of FIG. 1.
Figure 3:
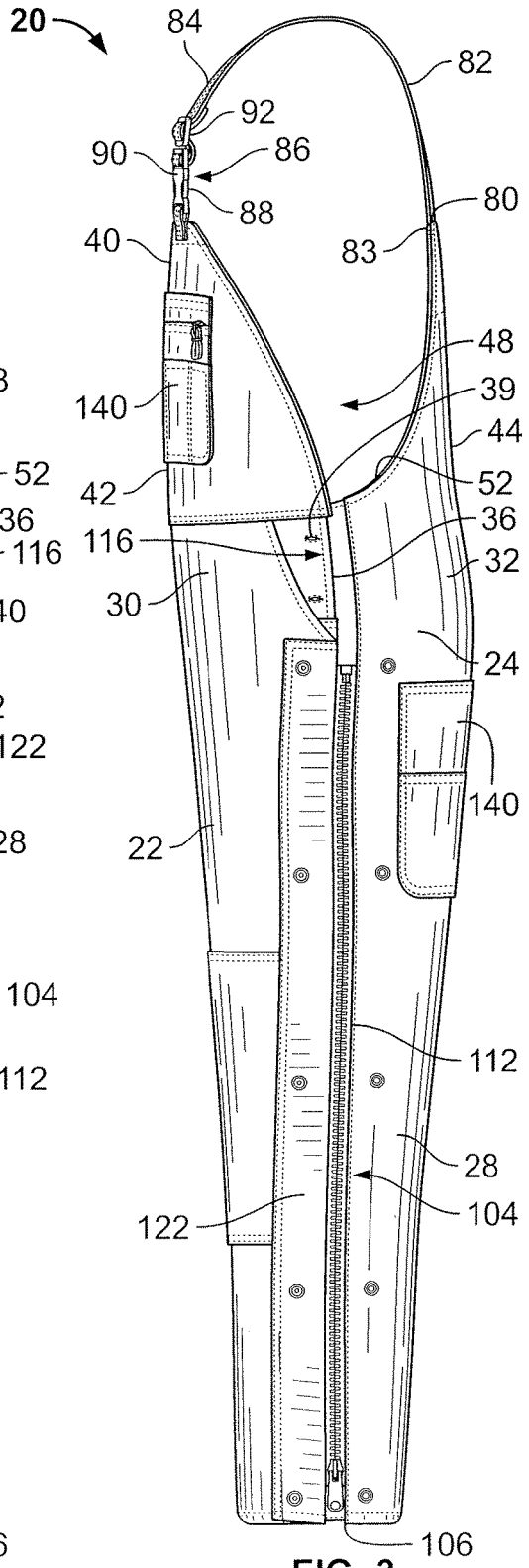
FIG. 3 is a side elevational view of the bib overalls of FIG. 1.
Figure 4:
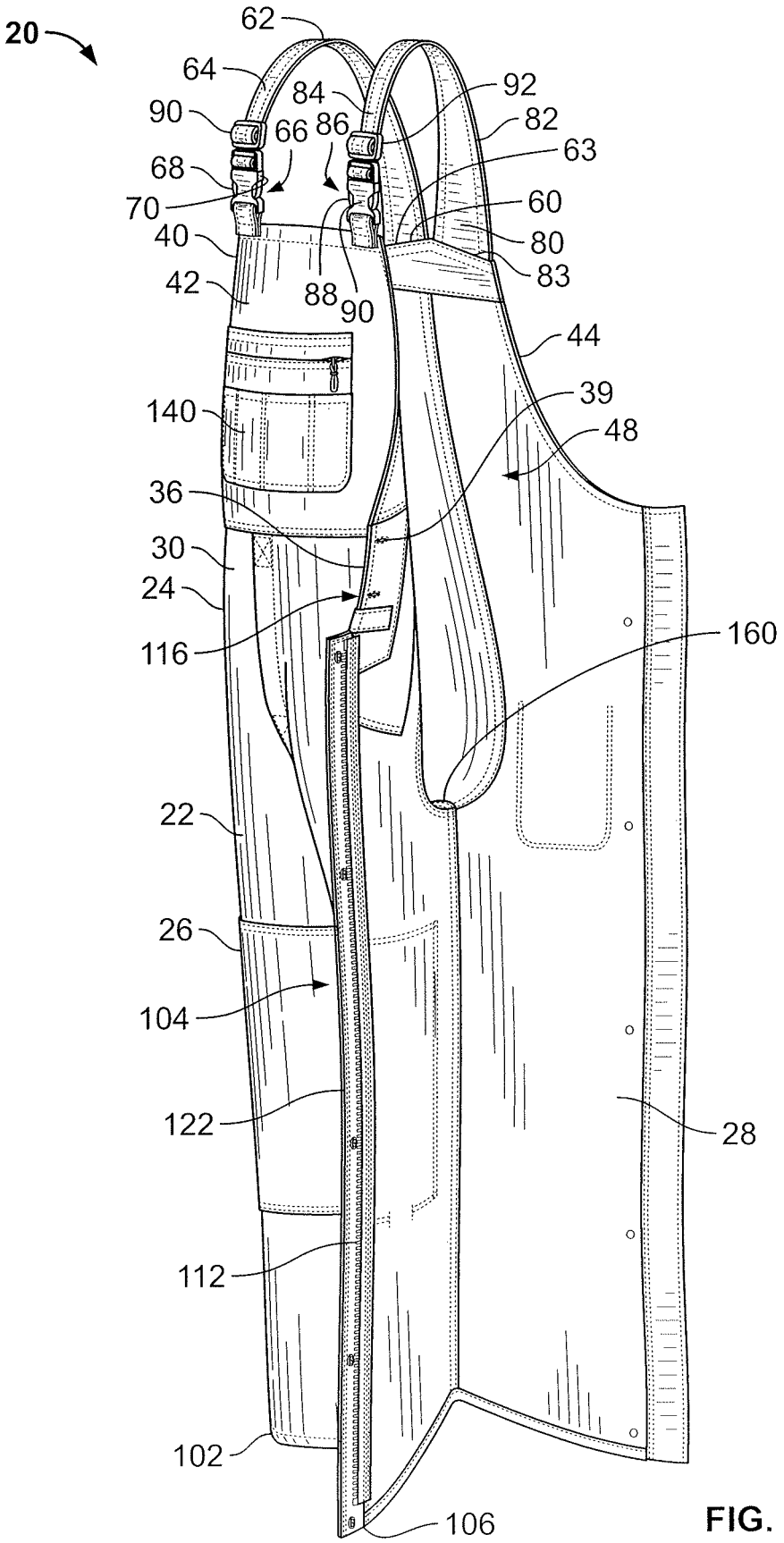
FIG. 4 is a top perspective view of the bib overalls of FIG. 1 with a fastener thereof unfastened.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Referring to FIG. 1, an illustrative embodiment of a garment in the form of bib overalls 20 is depicted. The bib overalls 20 include a trouser portion 22 including a trunk portion 24 and first and second legs 26, 28 connected to and extending away from the trunk portion 24. The trunk portion 24 includes a trunk front section 30, a trunk rear section 32, and first and second trunk side sections 34, 36 positioned between the trunk front and rear sections 30, 32. One or both of the trunk side sections 34, 36 may include one or more fasteners 38, 39, respectively, to loosen and/or tighten the trunk portion 24. The fasteners 38, 39 are shown in the figures as being buttons. Other exemplary fasteners include, but are not limited to, zippers, latches, any other suitable fasteners, or combinations thereof.

The bib overalls 20 further include a bib portion 40 having a bib front section 42 connected to and extending from the trunk front section 30 and a bib rear section 44 connected to and extending from the trunk rear section 32. First and second gaps 46, 48 having no material are formed between upper edges 50, 52 of the first and second trunk side sections 34, 36 and the bib front and rear sections 42, 44, respectively.

A first end 60 of a first strap 62 may be connected to the bib rear section 44, for example, by a first connector 63 and a second end 64 of the first strap 62 may be connected to the bib front section 42 by a second connector 66. In illustrative embodiments, the first connector 63 may be permanent and the second connector 66 may be non-permanent and may be in the form of, for example, a latch, a hook, hook and loop fasteners, or any other detachable connection. Alternatively, either of the first and second connectors 63, 66 between the bib rear section 44 and the first strap 62 and the bib front section 42 and the first strap 62 may be permanent or non-permanent. In the exemplary embodiment of FIGS. 1-4, the second connector 66 (and/or the first connection 63) includes a first latching component 68 on the first strap 62 and a second latching component 70 on the front bib section 42, wherein the first and second latching components 68, 70 interact to attach the first strap 62 to the front bib section 42.

Similarly, a first end 80 of a second strap 82 may be connected to the bib rear section 44, for example, by a first connector 83 and a second end 84 of the second strap 82 may be connected to the bib front section 42 by a second connector 86. In illustrative embodiments, the first connector 83 may be permanent and the second connector may be non-permanent and may be in the form of, for example, a latch, a hook, hook and loop fasteners, or any other detachable connection. Alternatively, either of the first and second connectors 83, 86 between the bib rear section 44 and the second strap 82 and the bib front section 42 and the second strap 82 may be permanent or non-permanent. Similar to the first strap 62, the second connector 86 (and/or the first connector 83) includes a third latching component 88 on the second strap 82 and a fourth latching component 90 on the front bib section 42, wherein the third and fourth latching components 88, 90 interact to attach the second strap 82 to the front bib section 42.

One or both of the straps 62, 82 may additionally include one or more adjuster elements 90 that allow for adjustment of a length of the straps 62, 82.

A first fastener 100 extends between an end 102 of the first leg 26 opposite the trunk portion 24 and the upper edge 50 of the first trunk side section 34. Similarly, a second fastener 104 extends between an end 106 of the second leg 28 opposite the trunk portion 24 and the upper edge 52 of the second trunk side section 26. The first and second fasteners 100, 104 extend from ends 102, 106 of the first and second legs 26, 28 to the gaps 46, 48, such that the material of the first and second legs 26, 28 may be completely separated when the fasteners are fully unfastened. The fasteners 100, 104 may be buttons, zippers, latches, any other suitable fastener(s), or combinations thereof. In the illustrative embodiment of FIGS. 1-4, the fasteners 100, 104 are each shown as having a first section 110, 112 formed of a detachable zipper and a second section 114, 116 formed of the fasteners 38, 39 in the form of buttons.

While two sections of different fasteners 100, 104 are shown, any number of fasteners may be utilized, as long as the material (in the legs 26, 28 and/or trunk portion 24) is completely separable. It should also be noted that the gaps 46, 48 may extend to the legs 26, 28, respectively, in which case the fasteners 100, 104 may only connect the legs 26, 28. Alternatively, the trunk side sections 34, 36 may extend any distance, for example, up to the armpits of a user, in which case, the gaps 46, 48 are formed as arm holes.

Still referring to FIGS. 1-4, flaps 120, 122 may extend from the legs 26, 28 and/or trunk side sections 34, 36 to cover all or a portion of the fasteners 100, 104. The flaps 120, 122 may be attached by a permanent connection at one end and any suitable detachable connection at an opposite end. The flaps 120, 122 may be used, for example, to cover metal parts for certain applications.

As can be seen in FIGS. 1-4, the bib overalls 20 may include any other typical features for overalls or coveralls, for example, pockets 140 with or without closures (for example, zippers, buttons, or any other suitable fasteners), loops for holding tools, key holders, or any other suitable features.

In an exemplary embodiment, a user puts on the bib overalls 20 by first unfastening the first and second fasteners 100, 104. The first and second straps 62, 82 are also detached from one or both of the front and/or rear bib sections 42, 44 (depending upon which connection(s) are detachable). A user then inserts the bib overalls 20 through his/her legs with an inner surface of a point of intersection 160 between the first and second legs 26, 28 disposed adjacent the user's inner thigh area. The user thereafter pulls one or both of the first and second straps 62, 82 over the shoulder of the user and fastens the appropriate strap 62, 82. The other strap 62, 82 may then optionally be fastened (or alternatively, may be fastened at a later time). After at least one of the straps 62, 82 is fastened, one of the first and second fasteners 100, 104, for example the first fastener 100, is fastened between the end 102 of the first leg 26 and the upper edge 50 of the first trunk side section 24. Similarly, the second fastener 104 is fastened between the end 106 of the second leg 28 and the upper edge 52 of the second trunk side section 26. As can be understood from the above-described method of putting on the bib overalls 20, a user never has to insert his/her feet through any portion of the bib overalls 20. This eliminates the need to balance on one leg or sit down to put the bib overalls 20 on. This method also eliminates the need to remove one's shoes before putting on the bib overalls 20, reduces the chances of soiling the inside of the bib overalls 20 during the process of the putting on the bib overalls 20, and reduces the need to drag the bib overalls 20 on the ground while putting them on.

The bib overalls 20 disclosed herein may be made of any suitable material. Non-limiting examples of materials include, but are not limited to, cotton, denim, polyester, fire resistant materials, duck fabric, any other suitable material(s), or combinations thereof. The bib overalls 20 may include one or more insulating layers, for example, on an inner surface thereof.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

What is claimed is:

1. A garment comprising:

a trouser portion including a trunk portion and first and second legs connected to and extending away from the trunk portion, the trunk portion including a trunk front section, a trunk rear section, and first and second trunk side sections positioned between the trunk front and rear sections;

a bib portion having a bib front section connected to the trunk front section and a bib rear section connected to the trunk rear section, wherein first and second gaps having no material are formed between upper edges of the first and second trunk side portions and the bib front and rear sections, respectively;

a first zipper;

a second zipper; and at least one fastener;

wherein the first zipper and the at least one fastener in combination extend along a length between an end of the first leg opposite the trunk portion and the upper edge of the first trunk side portion such that an entirety of the first leg is capable of opening to expose a leg of a person wearing the garment;

wherein the first zipper is positioned to fasten the first leg as the first zipper travels away from the upper edge of the first trunk side portion and towards the end of the first leg opposite the trunk portion;

wherein the second zipper extends between an end of the second leg opposite the trunk portion and the upper edge of the second trunk side portion; and wherein the second zipper is positioned to fasten the second leg as the zipper travels away from the upper edge of the second trunk side portion and towards the end of the second leg opposite the trunk portion.

2. The garment of claim 1, further including first and second straps connected between the bib front and rear sections.

3. The garment of claim 2, further including:

a first permanent connector connecting the first strap to the bib rear section;

a first non-permanent connector connecting the first strap to the bib front section;

a second permanent connector connecting the second strap to the bib rear section; and a second non-permanent connector connecting the second strap to the bib front section.

4. The garment of claim 3, wherein each of the first and second non-permanent connectors are selected from the group consisting of a button, a zipper, a latch, a hook, and hook and loop fasteners.

5. The garment of claim 1 further including a first flap that extends from the first leg and covers at least a portion of the first zipper.

6. A garment comprising:

a trouser portion including first and second legs;

a bib portion having a bib front section connected to a front portion of the trouser portion and a bib rear section connected to a rear portion of the trouser portion, wherein first and second gaps having no material are formed adjacent two opposing sides of the trouser portion between the bib front and rear sections; and at least a first fastener extending along an entire length of the first leg between an end of the first leg opposite the bib portion and an edge of the trouser portion forming one of the first and second gaps such that an entirety of the first leg is capable of opening to expose a leg of a person wearing the garment as the first fastener is pulled towards the bib portion, at least a second fastener extending along an entire length of the second leg between an end of the second leg opposite the bib portion and an edge of the trouser portion forming the other of the first and second leg gaps such that an entirety of the second leg is capable of opening to expose a leg of a person wearing the garment as the second fastener is pulled towards the bib portion;

wherein the garment includes a plurality of pockets, of which at least one pocket includes a zipper; and wherein the first and second fasteners include zippers.

7. The garment of claim 6, further including first and second straps connected between the bib front and rear sections.

8. The garment of claim 7, further including:

a first permanent connector connecting the first strap to the bib rear section;

a first non-permanent connector connecting the first strap to the bib front section;

a second permanent connector connecting the second strap to the bib rear section; and a second non-permanent connector connecting the second strap to the bib front section.

9. The garment of claim 8, wherein each of the first and second non-permanent connectors includes a first connector and a second connector detachably connected to one another.

10. The garment of claim 8, wherein each of the first and second non-permanent connectors are selected from the group consisting of a button, a zipper, a latch, a hook, and hook and loop fasteners.

11. The garment of claim 6, wherein the garment is made from a fire resistant material and at least one material selected from the group consisting of cotton, denim, and polyester.

12. A method of using a garment comprising a trouser portion including first and second legs, a bib portion having a bib front section connected to a front portion of the trouser portion and a bib rear section connected to a rear portion of the trouser portion, wherein first and second gaps having no material are formed adjacent two opposing sides of the trouser portion between the bib front and rear sections, at least a first zipper extending an entire length of the first leg between an end of the first leg opposite the bib portion and an edge of the trouser portion forming the first gap, and a at least a second zipper extending an entire length of the second leg between an end of the second leg opposite the bib portion and an edge of the trouser portion forming the second gap, the method comprising the steps of:

positioning the garment with the first and second zippers unfastened and with an inner surface of the trouser portion between the legs of a user, wherein the garment is made from a fire resistant material, and at least one material selected from the group consisting of cotton, denim, and polyester;

positioning the first and second legs of the garment around the legs of the user;

pulling a first strap attached to a first edge of the bib portion opposite the trouser portion over a first shoulder of a user;

fastening the first strap to a second edge of the bib portion;

pulling a second strap attached to the first edge of the bib portion opposite the trouser portion over a second shoulder of a user;

fastening the second strap to the second edge of the bib portion;

fastening the first zipper by pulling away from the bib portion;

fastening the second zipper by pulling away from the bib portion;

fastening a first pocket fastener and a second pocket fastener; and wherein the recited steps are performed without a user having to insert a foot through any portion of the garment.

13. The method of claim 12 further including the steps of:

unfastening the first zipper by pulling towards the bib portion;

unfastening the second zipper by pulling towards the bib portion; and removing the garment at least by pulling the garment through the legs of the user.

* * * * *